US006487818B1

(12) United States Patent
Hamann et al.

(10) Patent No.: US 6,487,818 B1
(45) Date of Patent: Dec. 3, 2002

(54) LIGHTED PARKING GATE

(75) Inventors: James D. Hamann, Florence, KY (US); Clarence W. Kemper, Jr., Budd Lake, NJ (US); Trey Mahoney, Middletown, OH (US); Gregg Theobald, Cincinnati, OH (US); Frank Benna, Bridgewater, NJ (US)

(73) Assignee: Amano Cincinnati, Inc., Roseland, NJ (US)

( * ) Notice: Subject to any disclaimer, the term of this patent is extended or adjusted under 35 U.S.C. 154(b) by 0 days.

(21) Appl. No.: 09/872,437

(22) Filed: Jun. 1, 2001

(51) Int. Cl.[7] ..... E01F 13/00
(52) U.S. Cl. ..... 49/49; 49/13
(58) Field of Search ..... 49/13, 49; 404/6, 404/9

(56) References Cited

U.S. PATENT DOCUMENTS 2,676,425 A * 4/1954 Bonanno ..... 49/13
4,784,356 A * 11/1988 Fox ..... 246/125
5,226,257 A * 7/1993 Moss ..... 49/13
6,104,313 A * 8/2000 Boyd ..... 340/908.1
6,189,839 B1 * 2/2001 Lemieux ..... 49/13
6,212,825 B1 * 4/2001 Hopkins ..... 49/49
6,267,332 B1 * 7/2001 Almblad ..... 246/294

FOREIGN PATENT DOCUMENTS

JP 8-150935 * 6/1996
JP 2000-238641 * 9/2000

* cited by examiner

*Primary Examiner*—Jerry Redman
(74) *Attorney, Agent, or Firm*—Stetina Brunda Garred & Brucker

(57) ABSTRACT

An automated parking gate structure is disclosed having enhanced safety features for deterring accidents and providing greater protectibility against damage in the event the gate arm strikes a vehicle. The parking gate comprises a base cabinet, a control mechanism disposed within the cabinet, and a gate arm connected to the cabinet, adapted for motion relative thereto in response to operation of the control mechanism. A first light element is disposed along a first surface of the gate arm. The light element being in communication with the control mechanism to regulate operation of the light element in response to operational modes of the gate control mechanism.

17 Claims, 3 Drawing Sheets

LIGHTED PARKING GATE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates to automated parking gates and, more particularly, to automated gates having its resilient lighting elements arrayed thereon.

Automated parking gates are a familiar feature throughout the American landscape. They function to allow selective access and exiting from parking areas, enhancing safety and convenience for intended users. Automated parking gates commonly operate under electronic control such that the need for operating personnel may be mitigated, or eliminated altogether.

As the development of automatic parking gates has matured, control functions and operational modes have become more sophisticated. Switch selectable features have also been implemented to offset timing and otherwise modify the operation of the gate in response to the sensed position of the vehicle, the direction the vehicle travels, etc.

While these and other improvements have been made to control functions of parking gates, basic mechanical features have remained substantially unchanged since the inception of the automated parking gate. The gate arm or boom is commonly implemented as a rigid member extending approximately ten feet from the housing. The arm may typically be formed of wood or other light-weight material that is sufficiently stiff to maintain its shape while being secured only at one end, adjacent the housing. As a consequence, the use of such arms are of course subject to cracking or breaking when the arm strikes some portion of a vehicle passing through the gate.

In order to mitigate prospects for harm to the gate, and enhance safety more generally, gate arms are commonly painted in a bright color or contrasting colors to enhance visual recognition of the gate. However, while such practices serve to enhance safe operation of the gate, additional steps are useful to distinguish the gate, to further mitigate to the potential for injury or damage resulting from impacting the gate.

One contemporary approach to enhancing the visibility of the gate is to use a light transmissive tube as the gate arm. As light is transmitted through the tube, the tube is illuminated and becomes more visible to the driver. However, for such tubes to function as a gate arm, they must have stiffness qualities as described in connection with wooden arms. As such, light transmissive tubes are similarly breakable, requiring replacement of the entire tube when accidents occur. Moreover, given to the stiffness of the tube, impact of the tube upon the hood of a car or the like may commonly cause scratching or denting of the car hood. This may not only be aggravating to the operator of the vehicle, but creates potential liabilities for the operator of the parking gate.

Accordingly, there exists a need to devise an automated parking gate having enhanced safety features for deterring the prospect of an accident, and providing greater protectibility against damage in the event that the gate arm strikes a vehicle. There further exists a need to provide such an improved automated parking gate having resilient lighting elements which define the lower surface of the gate arm, while providing protection against injury should the gate arm be lowered upon the surface of a vehicle. Further, a need exists for an improved parking gate having a means to install and replace lighting elements disposed on the gate arm or housing, without removing the gate arm from the housing, or otherwise require disassembling of the housing. Still further, there exists a need to provide these and other features and advantages in an improved automated parking gate, while retaining the economies of low product cost, low operating cost, and lower prospect of vehicle injury and consequent damage claims. These and other objects and advantages are implemented by means of the present invention as set forth below in connection with the illustrated drawings.

BRIEF SUMMARY OF THE INVENTION

An automated parking gate structure is disclosed having enhanced safety features for deterring accidents and providing greater protectibility against damage in the event the gate arm strikes a vehicle. The parking gate comprises a base cabinet, a control mechanism disposed within the cabinet, and a gate arm connected to the cabinet, adapted for motion relative thereto in response to operation of the control mechanism. A first light element is disposed along a first surface of the gate arm. The light element being in communication with the control mechanism to regulate operation of the light element in response to operational modes of the gate control mechanism.

In the presently preferred embodiment, the first light element is disposed along the lower surface of the gate arm, and formed of flexible plastic material that is resiliently deformable upon impact of the material onto a vehicle surface.

The first light element may be formed as a length of fiber optic material, illuminated by a light source disposed within the cabinet. Alternatively, the first light element may be formed as a string of electrically interconnected lights, encased within flexible plastic tubing, the tubing being deformable upon impact of the material onto a vehicle surface.

The first light element is preferably manually engageable/disengageable from the gate arm without the use of tools. In one embodiment, the gate arm is grooved and the first light element is formed to include a flange, adapted for cooperative engagement to the gate arm groove. In another embodiment, the gate arm is formed to include at least one support member, adapted to receive and support the first light element adjacent the gate arm.

In one embodiment, the cabinet is provided with a junction box to facilitate plug engagement/disengagement of the first light element to the light source and gate arm without disassembly of the cabinet, or disengagement of the gate arm from the cabinet.

A second light element is provided upon an upper surface of the cabinet, and a hood is disposable thereover. The hood is preferably formed of translucent material such that it is illuminated in response to activation of the second light element. As with the first light element, the second light element may be implemented in various embodiments, including an incandescent lamp, or a length of fiber optic material. The first and second light elements may also be illuminated by a common light source, disposed within the cabinet. The parking gate control mechanism may be operative to illuminate either or both of the first and second light elements in response to the operational mode of the gate control mechanism. Both first and second light elements may be illuminated in one or more of a plurality of light patterns, responsive to the operational mode of the gate control mechanism.

BRIEF DESCRIPTION OF THE DRAWINGS

These as well as other features of the present invention will become more apparent upon reference to the drawings wherein.

DETAILED DESCRIPTION OF THE INVENTION

The detailed description set forth below in connection with the drawings is intended as a description of the presently preferred embodiment of the invention, and is not intended to represent the only forms in which the present invention may be constructed or utilized. The description sets forth the functions and the sequence of the steps for constructing and operating the invention in connection with the illustrated embodiments. It is to be understood that the same or equivalent functions may be accomplished by different embodiments that are also intended to be encompassed within the scope of the invention.

Figure 1:
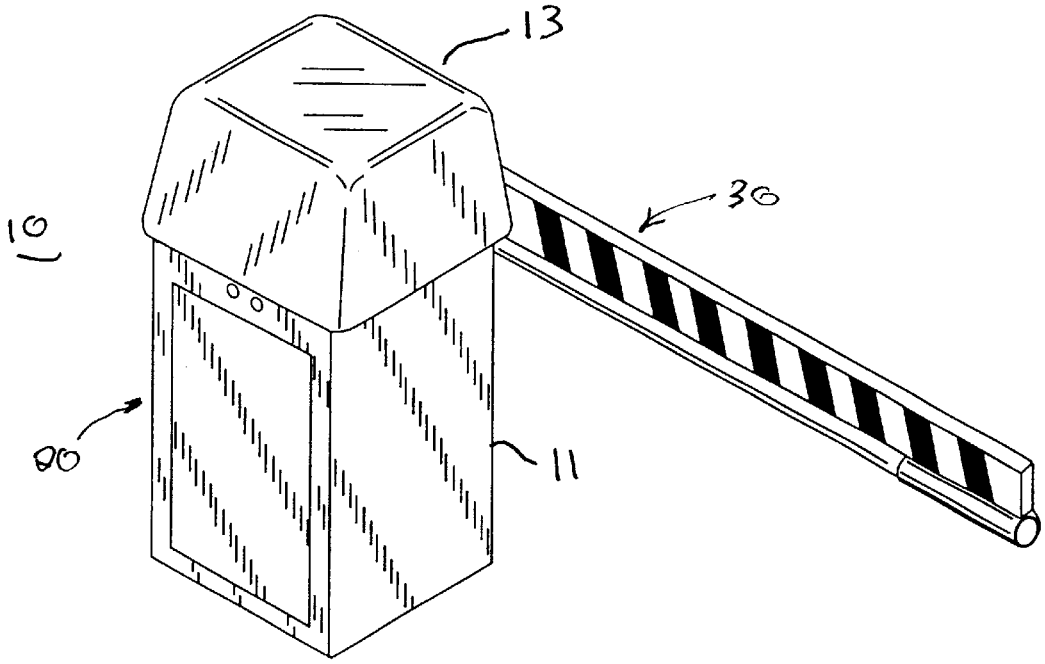
FIG. 1 is a front perspective view of an automated parking gate in accordance with the present invention.

Referring to FIG. 1, an automated parking gate 10 is shown in accordance with the present invention. The automated parking gate 10 includes a gate cabinet 20 and a gate arm or boom 30. The gate cabinet 20 houses the gate motor and gate control mechanism of the automated parking gate 10.

The exterior of the cabinet 20 is defined by lower housing 11 and hood 13. The hood 13 is detachably connectible to the housing 13. The hood 13 is preferably formed of molded plastic material having translucent characteristics. In come cases, the hood may be colored as desired, while retaining the translucent characteristics. Lettering and/or graphics may be applied to the hood, in the manufacturing process and/or at the time of installation. The lettering or graphics may include safety information relating to the environment where the automated parking gate is disposed. Alternatively, the lettering or graphics may convey other information identifying the operator of the parking gate, building, etc.

Figure 2:
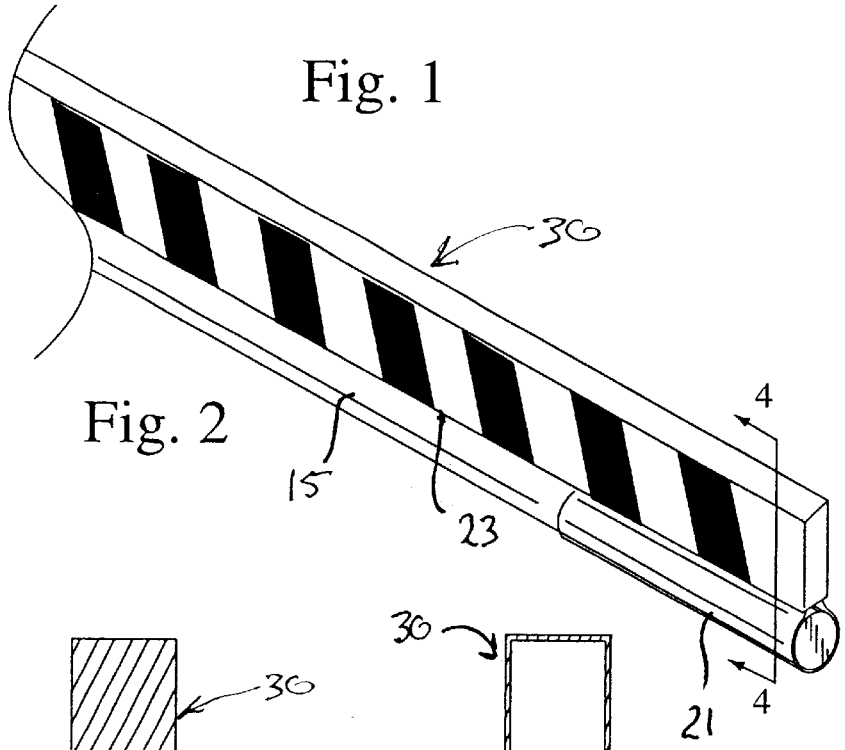
FIG. 2 is an enlarged perspective view showing a portion of a first light element engaged to the gate arm.
Figure 6A:
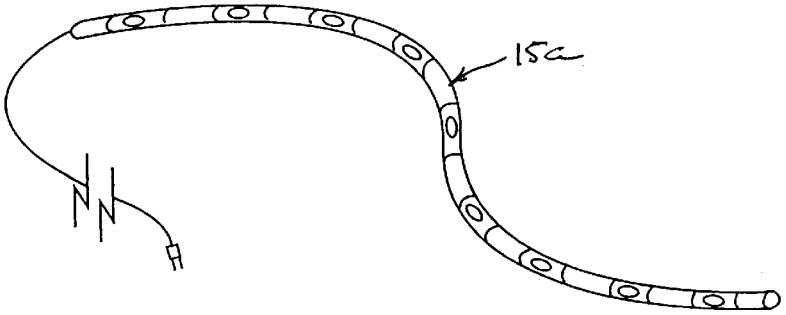
FIGS. 6*a* and 6*b* are perspective views of flexible light elements usable in conjunction with the present invention.
Figure 6B:
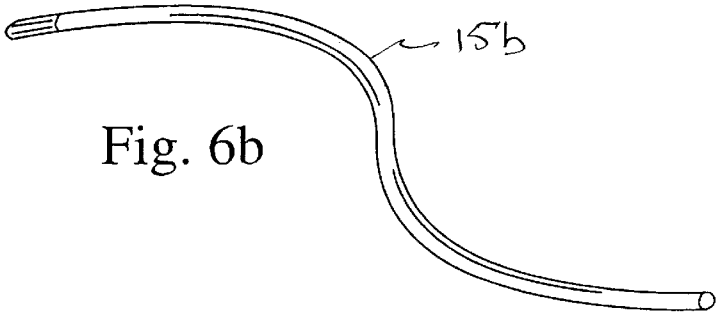

Referring to FIG. 2, the gate arm 30 is shown to include a first light element 15 disposed upon the lower surface thereof. The first light element 15 may be formed as a length of flexible tubing having light transmissive characteristics. In one embodiment, the first light element may be implemented as a light string (FIG. 6*a*), formed as a flexible string of electrically connected lights disposed within a length of flexible tubing. In another embodiment, the first light element 15 may be implemented as a length of fiber optic tubing 15*b* (FIG. 6*b*) connected to a light source disposed within the cabinet.

Figure 3:
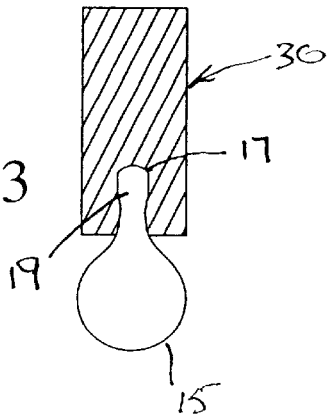
FIG. 3 is a sectional view illustrating an exemplary interconnection between the gate arm and the first light element.
Figure 4:
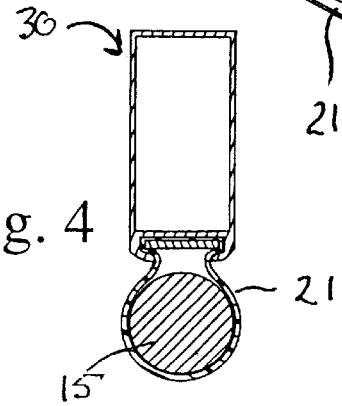
FIG. 4 is a sectional view illustrating an alternate interconnection between the gate arm and the first light element.

Referring to FIGS. 3 and 4, the first light element may be connected to the gate arm in any of a variety of ways. As shown in FIG. 3, the gate arm 30 may be provided with a groove 17 extendable along the length thereof. In such case, the first light element 15 may be provided with an extension, such as flange 19, adapted for frictional engagement to the gate arm within groove 17.

Referring to FIGS. 2 and 4, another embodiment is disclosed including a tubular receiving member 21, secured to the gate arm 30. The first light element 15 is receivable within the receiving element 21, to support the first light element adjacent the lower surface 23 of gate arm 30.

Figure 5:
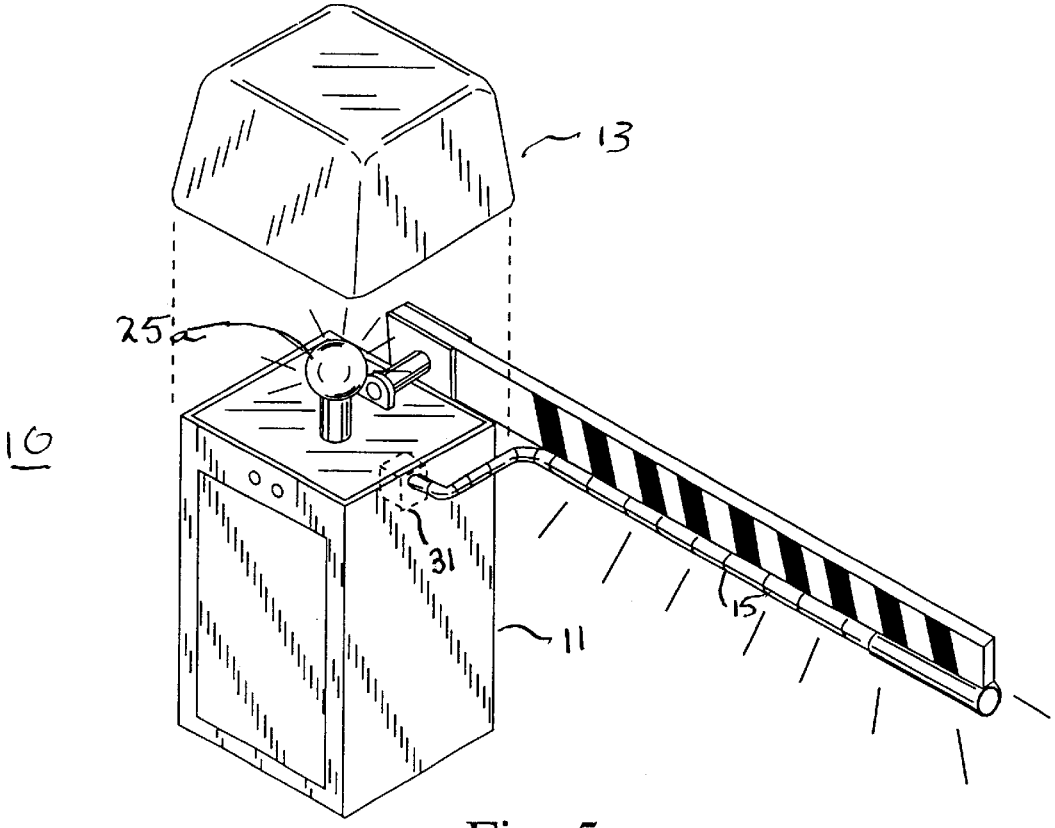
FIG. 5 is an exploded view illustrating the removable hood and a second light element disposed upon the upper surface of the housing.
Figure 7:
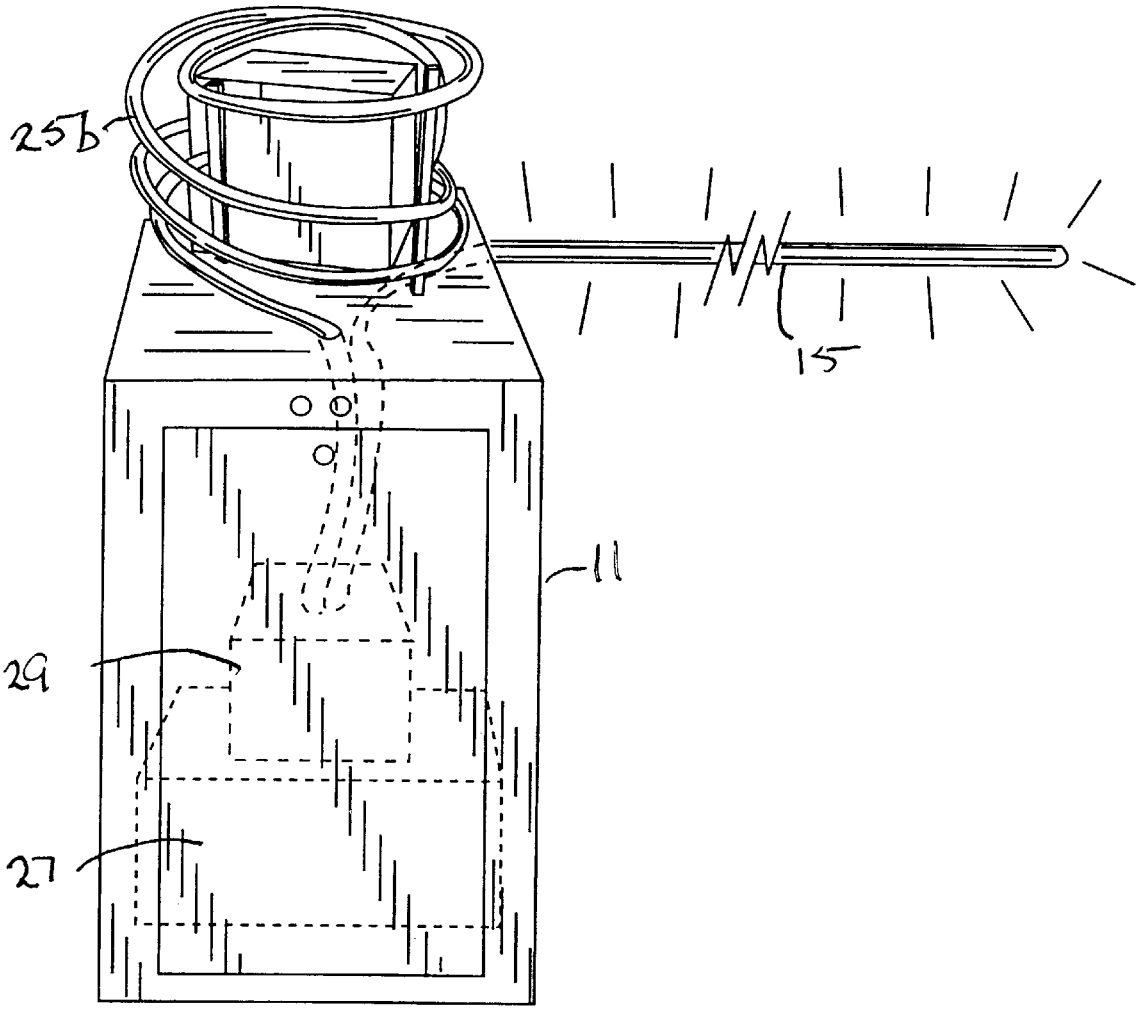
FIG. 7 is a perspective view of first and second light elements connected to a common light source and to the gate control mechanism.

FIG. 5 illustrates separation of the hood 13 from lower housing 11, to reveal second light element 25*a*, disposed upon the upper surface of housing 11. The second light element 25*a*, along with first light element 15, may be illuminated in any of a variety of light patterns in response to the operational mode of control mechanism 27, as shown in FIG. 7. The first light element 15 and second light element 25*a* may operate simultaneously, or in separate patterns, as desired.

Referring to FIG. 7, the second light element 25*b* may be implemented as a length of fiber optic tubing illuminated by a light source 29 disposed within the housing 11. Accordingly, both the first and second light sources may be implemented as length of fiber optic material connected to a common light source 29 disposed within the housing 11.

Referring again to FIG. 5, the housing 11 may additionally be provided with a junction box 31, to which the first light element is plug connectible, either electrically or optically. As such, the first light source 15 may be disconnected from the light source 29, and removed from the gate arm 30 by manual means, without tools, without disconnecting the gate arm from the housing and without opening or otherwise disassembling the housing 11.

As shown at FIG. 5, the hood 13 is illuminated by a light source 15 disposed within cabinet 20. The light source 15 may be one or more other light sources operated under the control of the parking gate control mechanism. As described in more detail below, the control mechanism may be operative to active different light patterns in conformance to the operational mode of the parking gate. For example, the parking gate control mechanism may operate to flash the light source, or vary the intensity of the light source, whenever the gate arm 30 is moved from the closed position, i.e., when the gate arm down limit switch is disengaged. As such, the illuminated hood may serve as an area light when the gate is closed, while providing an additional warning function when the gate is open. As will be recognized by those skilled in the art, the particular lighting sequence may be varied in accordance with the operating environment and operational mode of the parking gate, without departing from the broader aspects of the invention.

Additional modifications and improvements of the present invention may also be apparent to those of ordinary skill in the art. Thus, the particular combination of parts described and illustrated herein is intended to represent only a certain embodiments of the present invention and is not intended to serve as a limitation of alternative devices also within the spirit and scope of the invention.

What is claimed is:

1. An automated parking gate comprising:

a) a base cabinet;

b) a parking gate control mechanism disposed within the cabinet;

c) a gate arm connected to the cabinet and adapted for motion relative thereto in response to operation of the control mechanism; and d) a first light element disposed along a first surface of the gate arm, the light element being in communication with the gate control mechanism to regulate operation of the light element in response to operational modes of the gate control mechanism e) wherein the first light element is formed as a length of fiber optic material, illuminated by a light source disposed in the cabinet.

2. The parking gate as recited in claim 1 wherein the first light element is disposed along a lower surface of the gate arm.

3. The parking gate as recited in claim 1 wherein the fiber optic material is formed as a length of flexible plastic material, the flexible plastic material being resiliently deformable upon impact of the plastic material onto a vehicle surface.

4. The parking gate as recited in claim 3 wherein the first light element is disposed along a lower surface of the gate arm.

5. The parking gate as recited in claim 4 wherein the first light element is disposed along a lower surface of the gate arm.

6. The parking gate as recited in claim 5 wherein the first and second light elements comprise lengths of fiber optic material.

7. The parking gate as recited in claim 5 wherein the parking gate control mechanism is operative to illuminate the first and second lighting elements in response to operational mode of the gate control mechanism.

8. The parking gate as recited in claim 7 wherein the first and second light elements are illuminated simultaneously.

9. The parking gate as recited in claim 4 wherein the first light element is in electrical plug communication with the control mechanism via a junction box disposed upon an exterior surface of the cabinet.

10. The parking gate as recited in claim 9 wherein the first and second light elements are illuminated by a common light source disposed in the cabinet.

11. The parking gate as recited in claim 1 wherein the gate arm includes at least one support member connected to the gate arm first surface, for receiving and supporting the first light element adjacent the gate arm.

12. The parking gate as recited in claim 1 wherein the first light element is plug connectable to the light source.

13. The parking gate as recited in claim 12 wherein the first light element is replaceable upon manual disengagement/engagement of the first light element to the gate arm and the light source.

14. The parking gate as recited in claim 13 wherein the first light element is manually replaceable without disengagement of the gate arm and the cabinet.

15. The parking gate as recited in claim 13 wherein the first light element is manually replaceable without disassembly of the cabinet.

16. An automated parking gate comprising:

a) a base cabinet;

b) a parking gate control mechanism disposed within the cabinet;

c) a gate arm connected to the cabinet and adapted for motion relative thereto in response to operation of the control mechanism; and d) a first light element disposed along a first surface of the gate arm, the light element being in communication with the gate control mechanism to regulate operation of the light element in response to operational modes of the gate control mechanism e) wherein the first light element is formed as a string of electrically interconnected lights encased within a length of flexible plastic tubing, the tubing being deformable upon impact of the material onto a vehicle surface.

17. An automated parking gate comprising:

a) a base cabinet;

b) a parking gate control mechanism disposed within the cabinet;

c) a gate arm connected to the cabinet and adapted for motion relative thereto in response to operation of the control mechanism; and d) a first light element disposed along a first surface of the gate arm, the light element being in communication with the gate control mechanism to regulate operation of the light element in response to operational modes of the gate control mechanism e) wherein a first light element includes a flange, extending substantially the length thereof, for manual engagement to the gate arm groove; and f) wherein the gate arm is grooved for toolless engagement to the first light element.

* * * * *